United States Patent [19]

Ishii et al.

[11] 4,412,696

[45] Nov. 1, 1983

[54] DOOR HANDLE DEVICE FOR AN AUTOMOTIVE VEHICLE

[75] Inventors: Katsumi Ishii, Tokyo; Takayo Chikaraishi, Kawasaki, both of Japan

[73] Assignee: Nissan Motor Company, Limited, Yokohama, Japan

[21] Appl. No.: 274,766

[22] Filed: Jun. 18, 1981

[30] Foreign Application Priority Data

Jul. 29, 1980 [JP] Japan ..... 55-103027

[51] Int. Cl.[3] ..... E05C 13/00

[52] U.S. Cl. ..... 292/336.3

[58] Field of Search ..... 292/336.3, 216, 280, 292/347, DIG. 31, 196; 70/208

[56] References Cited

U.S. PATENT DOCUMENTS 2,348,065 5/1944 George ..... 292/DIG. 31
3,858,921 1/1975 Koki ..... 292/336.3
3,967,844 7/1976 Torii et al. ..... 292/336.3
4,116,027 9/1978 Tannery ..... 292/DIG. 31

FOREIGN PATENT DOCUMENTS 2418172 10/1975 Fed. Rep. of Germany .
2656011 6/1978 Fed. Rep. of Germany .
1343267 1/1974 United Kingdom .

*Primary Examiner*—Richard E. Moore
*Attorney, Agent, or Firm*—Lane, Aitken & Kananen

[57] ABSTRACT

A door handle device used for an automotive vehicle provided with a resin handle box. Therefore, the door handle device of the present invention is lightweight and inexpensive. The structure of the door handle device is such that almost the entire inside surface of the handle box is in contact with the recessed portion of the door panel. Since a force applied to the handle body is transmitted to the door panel through the handle box without any application of bending or shearing force to the handle box, it is possible to use a resin handle box.

7 Claims, 7 Drawing Figures

DOOR HANDLE DEVICE FOR AN AUTOMOTIVE VEHICLE

BACKGROUND OF THE INVENTION

1. Field of the Invention

The present invention relates generally to a door handle device used for an automotive vehicle, and more specifically a resin handle box used with a door handle device.

2. Description of the Prior Art

In the prior-art door handle devices, since a handle body is rotatably attached to a handle box and the handle box is fixed to the door panel with only the periphery thereof being brought into contact with the door panel, a force applied to the handle body is transmitted to the handle box as a bending force or a shearing force. Therefore, it is necessary to use a handle box made of a strong material, for instance, such as zinc, which is made by relatively expensive zinc die-casting processes. In addition to the above problem, it has been necessary to dispose a rubber end cap between the handle box and the door panel in order to protect the painted door panel from scratches or damage and to reduce the sound produced when the door handle is operated.

A more detailed description of the prior-art door handle device used for an automotive vehicle will be made hereinafter with reference to FIGS. 1–3 under DETAILED DESCRIPTION OF THE PREFERRED EMBODIMENT.

SUMMARY OF THE INVENTION

With these problems in mind therefore, it is the primary object of the present invention to provide a lightweight, low-cost, simple, resin door handle device used with an automotive vehicle, the structure of which is such that a force applied to the handle body is transmitted to the door panel directly without application of bending or shearing force to the handle box.

To achieve the above-mentioned object, the door handle device according to the present invention comprises a handle bracket to which a handle body is mounted and a resin handle box to which a key cylinder is mounted. And, the entire periphery of the handle box is attached to the door panel and is installed between the handle bracket and the door panel.

BRIEF DESCRIPTION OF THE DRAWINGS

The features and advantage of the door handle device used for an automotive vehicle according to the present invention will be more clearly appreciated from the following description taken in conjunction with the accompanying drawings in which like reference numerals designate corresponding elements and in which.

DETAILED DESCRIPTION OF THE PREFERRED EMBODIMENTS

Figure 1:
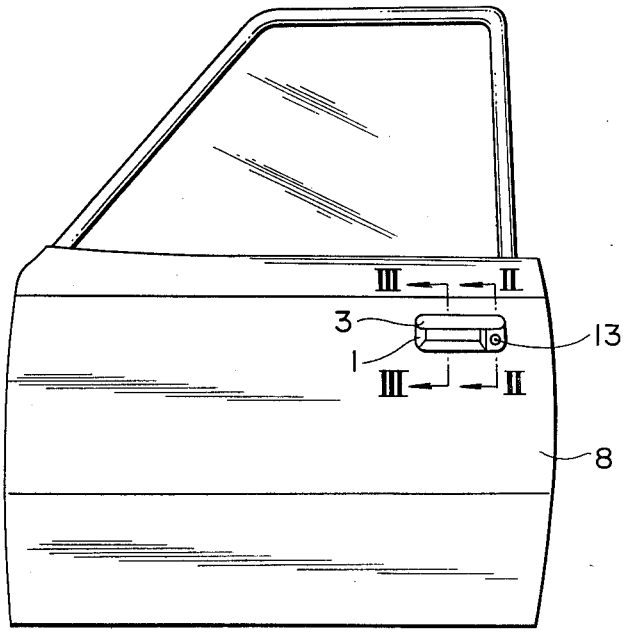
FIG. 1 (PRIOR ART)
FIG. 1 is a front view of the vehicle front door provided with a prior-art door handle device.
Figure 2:
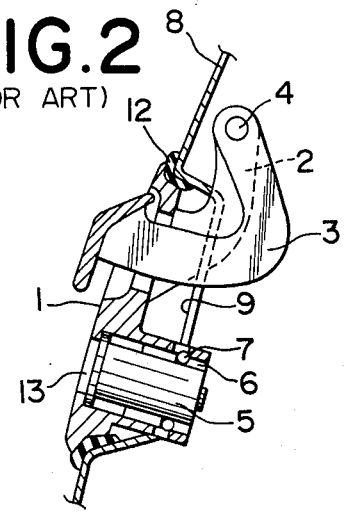
FIG.2 (PRIOR ART)
FIG. 2 is a cross-sectional view of the prior-art door handle device taken along the lines II—II of FIG. 1.
Figure 3:
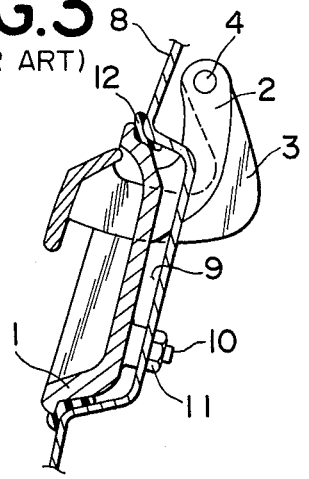
FIG.3 (PRIOR ART)
FIG. 3 is a cross-sectional view of the prior-art door handle device taken along the lines III—III of FIG. 1.

To facilitate understanding of the present invention, a brief reference will be made to a prior-art door handle device used with an automotive vehicle with reference to FIGS. 1–3. In these door handle devices, an arm 2 is integrally formed with a handle box 1, and a handle body 3 is rotatably supported to the arm 2 by the use of a C-shaped ring 4. Also, a key cylinder 5 is inserted through a hole 6 formed in the handle box 1 from the inside and fixed thereto by a pin 7. The door handle device thus assembled is fixed into a recessed portion 9 of a door panel 8 by using two stud bolts 10 (in FIG. 3) provided for the handle box 1 and two nuts 11. Since a force applied to the handle body 3 is directly transmitted from the arm 2 to the handle box 1 as a bending force, it is necessary to use a strong arm and a strong handle box, such as those manufactured by the processes of zinc die casting, which are heavy and costly. In addition to the above, in order to fix such a metal handle box 1 as described above to the door panel 8, it has been necessary to place a rubber end cap 12 therebetween for prevention of damage to the painted surface of the door panel 8 and for reduction of sound generated when the door handle is operated.

Figure 4:
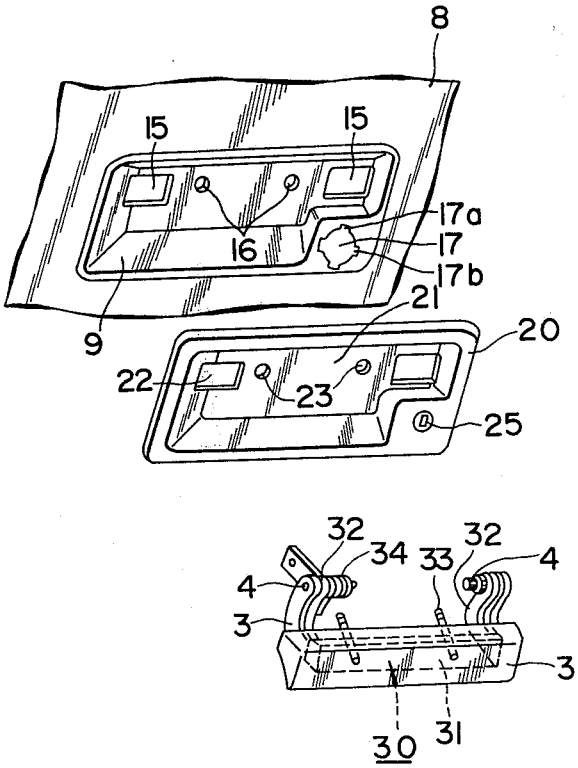
FIG. 4 is an exploded perspective view of an embodiment of a door handle device according to the present invention.

In view of the above description, reference is now made to FIGS. 4–7, and specifically to FIG. 4, in which a preferred embodiment of the door handle device used with an automotive vehicle according to the present invention is illustrated.

Figure 5:
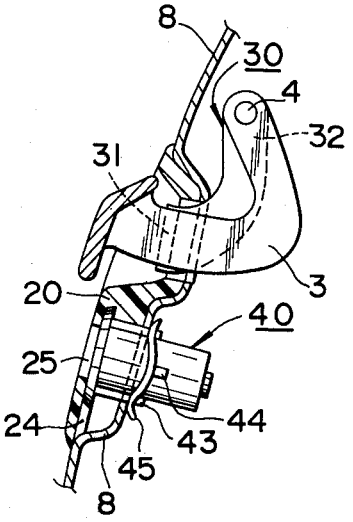
FIG. 5 is a cross-sectional view of the embodiment of the door handle device according to the present invention, taken along the lines including the key cylinder in the same manner as in FIG. 2.

The door handle device according to the present invention roughly comprises a door panel 8, a handle box 20 to which a key cylinder as in FIG. 5 is assembled, and a handle bracket 30 to which a handle body 3 is assembled. The handle bracket 30 comprises a flat portion 31 extending along a recessed surface of a recessed portion 21 of the handle box 20 and arm portions 32 bent so as to project outward at a right angle on either side of the flat portion 31. Two stud bolts 33 are implanted in the flat portion 31. Further, this bracket 30 must be made of a strong material such as steel. The handle body 3 is rotatably supported by two pins 4 at the arm portions 32 of the handle bracket 30, and is urged by a return spring 34 toward the flat portion 31 of the handle bracket 30, that is, inwardly. Further in this embodiment, when the handle body is rotated outwardly, the door is unlocked.

The handle box 20 is provided with a recessed portion 21 in which the handle body 3 is installed and into which the user reaches in order to open the door. In the recessed portion 21, there are provided two rectangular openings 22 through which the arm portions 32 are passed and two holes 23 through which the stud bolts 33 are passed. In reference to FIG. 7, on the rear side of the handle box 20, there are provided a retaining groove 24 into which the head 41 of the key cylinder 40 is fitted and a key hole 25 with its center located at an appropriate position relative to the fitting groove 24. The handle box 20 thus constructed is formed of a light-weight, low-cost resin such as polypropylene or vinyl chloride.

In the door panel 8, there is provided an embossed portion 9 (in FIG. 4) to which the handle box 22 is fitted. And in the recessed portion 9, there are provided two rectangular arm-admitting holes 15 and two holes 16 corresponding to the two openings 22 and the two holes 23, respectively, and a hole 17 into which the housing 42 of the key cylinder 40 is passed through. On the periphery of the hole 17, there are provided two slots 17*a* into which the tabs 43 of the key cylinder 40 are fitted to prevent the rotation of the cylinder 40 and two other slots 17*b* to which two clip-restraining projections 44 as described hereinafter are fitted.

Figure 6:
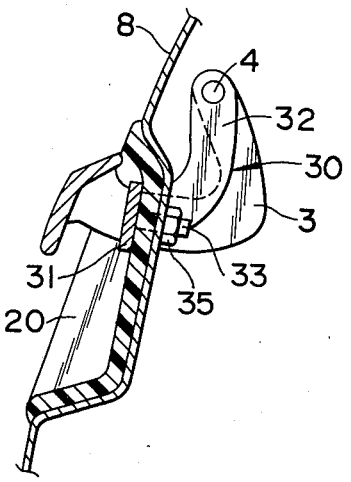
FIG. 6 is a cross-sectional view of the embodiment of the door handle device according to the present invention excluding the key cylinder, taken along the lines in the same manner as in FIG. 3.
Figure 7:
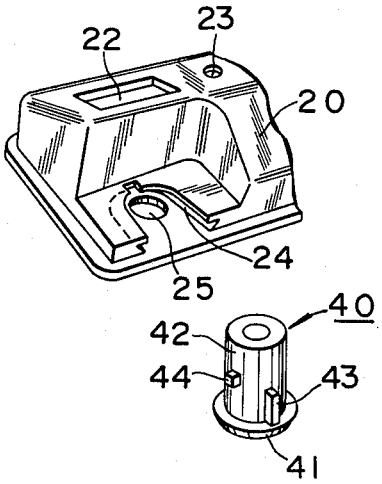
FIG. 7 is a fragmentary exploded perspective view of the embodiment of the door handle device according to the present invention, for assistance in explaining the fitting of the key cylinder to the handle box.

The method of assembling the door handle device is described hereinbelow. First, the head 41 of the key cylinder 40 is fitted to the retaining groove 24 of the handle box 20. The retaining groove 24 is designed such that the key cylinder 40 does not fall out easily. Next, the handle box 20 is fitted to the embossed portion 9 of the door panel 8 with the key cylinder 40 inserted into the hole 17. In this case, since the arm-admitting holes 15 coincide with the holes 22 and the holes 16 coincide with the holes 23, the handle body 3 is set with the arm portions 32 of the handle bracket 30 set through the openings 22 and 15 and with the stud bolts 33 set through the holes 23 and 16. The flat portion 31 of the handle bracket 30 is brought into contact with the recessed portion 21 of the handle box 20, the nuts 35 are screwed on the stud bolts 33 projecting through the rear side of the door panel 8 in order to fix the handle box 20 to the door panel 8, and, as a result, the handle box 20 is sandwiched by the door panel 8 and the flat portion 31 of handle bracket 30 firmly, as depicted in FIG. 6.

Further, in this embodiment, a disk-shaped clip 45 is put between the clip-restraining projection 44 of the key cylinder 40 projecting through the rear side of the door panel 8 and the door panel 8 to fix the key cylinder 40 firmly in order to prevent its falling out and to hold the handle box 20 against the door panel 8 in order to prevent its detachment from the surface of the door panel 8. However, this clip 45 may be unnecessary if the key cylinder 40 is firmly fixed to the handle box 20.

In the door handle device thus assembled, when the handle body 3 is rotated upward to unlock the door, the rotational force in reaction thereof is transmitted directly through the arm portion 32, that is, from the flat portion 31 of the handle bracket 30 to the door panel 8 to which the handle box 20 is fixed. Therefore, no strong bending or shearing force is applied directly to the handle box 20. Further, when the key inserted into the key cylinder 40 is rotated, the reactional rotational force is applied to the slots 17*a* in the door panel 8 without applying a strong torsional force onto the handle box. In this embodiment, however, when the key cylinder 40 is pushed against or retracted from the handle box 20, the respective bending forces are applied to the handle box 20. Additionally, the retracting force of the key cylinder 40 is applied to the clip 45.

As described above, in the door handle device according to the present invention, since the handle box is fixed to the door panel with almost the whole surface thereof being brought into contact with the door panel, a force applied to the handle body is directly transmitted to the door panel through the handle box without any application of bending or shearing force to the handle box; thus, it is possible to make the handle box of resin, thus reducing the cost thereof while eliminating the need for an end cap.

In addition, since the key cylinder is fixed by a disk clip after having been inserted into the retaining groove of the handle box for temporary fixing, even when the key cylinder is struck from the outside, the force is received by the door panel through the handle box to prevent the key cylinder from falling out, thus improving the door handle device from the standpoint of crime prevention.

It will be understood by those skilled in the art that the foregoing description is in terms of preferred embodiments of the present invention wherein various changes and modifications may be made without departing from the spirit and scope of the invention, as set forth in the appended claims.

What is claimed is:

1. A door handle device for an automotive vehicle which comprises:

(a) a door panel having a recessed portion provided with two arm-admitting holes and a cylinder hole, (b) a handle box having two arm-admitting holes and a cylinder hole, said handle box being almost the same in shape as the recessed portion of said door panel so that almost the whole outside surface of said handle box can be closely brought into contact with the recessed portion of said door panel;

(c) a handle bracket having two arm portions and a flat portion, said handle bracket being fixed to the recessed portion of said door panel with said handle box sandwiched between the flat portion of said handle bracket and the recessed portion of said door panel, the two arm portions being passed through the two arm-admitting holes of said handle box and the recessed portion of said door panel; and (d) a handle body for unlocking the door, said handle body being rotatably supported by said handle bracket, whereby no bending or shearing force is applied to said handle box when said handle body is rotated to unlock the door.

2. A door handle device for an automotive vehicle as set forth in claim 1, which further comprises a key cylinder mounted to said handle box being passed through the cylinder hole of said door panel and said handle box, said key cylinder being provided with two tabs.

3. A door handle device for an automotive vehicle as set forth in claim 2, wherein a groove is provided for said handle box into which the head of said key cylinder can be fitted.

4. A door handle device for an automotive vehicle as set forth in claim 2, wherein two slots are provided for the cylinder hole of the recessed portion of said door panel into which the tabs of said key cylinder can be fitted to prevent the rotation of said key cylinder.

5. A door handle device for an automotive vehicle as set forth in claim 2, which further comprises two stud bolts implanted in said handle bracket to affix said handle box to the recessed portion of said door panel.

6. A door handle device for an automotive vehicle as set forth in claim 2, which further comprises a return spring to urge said handle body toward said handle bracket.

7. A door handle device for an automotive vehicle as set forth in any of claims 1 to 6, wherein said handle box is made of resin.

* * * * *